United States Patent [19]

Slenker

[11] Patent Number: 4,950,858

[45] Date of Patent: Aug. 21, 1990

[54] BOOT HEATER

[76] Inventor: Stephen Slenker, 10 Crabapple La., Chelmsford, Mass. 01824

[21] Appl. No.: 448,931

[22] Filed: Dec. 12, 1989

Related U.S. Application Data

[63] Continuation of Ser. No. 342,868, Apr. 25, 1989.

[51] Int. Cl.[5] ..... A43B 7/04; H05B 3/36

[52] U.S. Cl. ..... 219/211; 36/2.6

[58] Field of Search ..... 219/211, 523; 36/117, 36/2.6; 320/2; 446/484

[56] References Cited

U.S. PATENT DOCUMENTS

| | | | |
|---|---|---|---|
| 3,477,173 | 11/1969 | Mabuchi | 446/165 |
| 3,793,769 | 2/1974 | Tong | 446/484 |
| 3,859,496 | 1/1975 | Giese | 219/211 |
| 4,780,968 | 11/1988 | Bragagnolo | 219/211 |

*Primary Examiner*—Teresa J. Walberg

*Attorney, Agent, or Firm*—Wolf, Greenfield & Sacks

[57] ABSTRACT

A ski boot heater includes a bracket adapted to be secured to the outside of a ski boot. A housing containing electrical batteries is detachably secured in watertight engagement to the bracket. The housing is shaped to carry at least one battery and electrical contacts for selectively electrically inter-engaging contacts in the bracket. A spring means normally maintains the housing and bracket in a watertight relation.

11 Claims, 1 Drawing Sheet

BOOT HEATER

This is a continuation of Ser. No. 342,868, filed Apr. 25, 1989.

FIELD OF THE INVENTION

The present invention relates to an improved means for heating boots, such as ski boot, and in particular to an improved power control for boot heaters.

BACKGROUND OF THE INVENTION

Currently available heating systems for ski boot are generally battery powered. These battery powered ski boot heaters require means for turning the battery power on and off. The systems are generally either molded integrally into the boot or attached to the outside. In each case, some type of switch mechanism is required.

Insofar as the applicant is aware, currently available controls are unreliable since they are generally unsealed and therefore susceptible to moisture damage. Additionally-, many controls are provided with simple knobs which are not particularly sturdy, project unnecessary far from the boot and therefore are easily broken or susceptible to damage. Since ski boots, hiking boots and other footwear having such heat controls are subject to frequent mechanical shock and impact, damage to the heating controls is quite common.

Additionally, some controls for boot heating elements use battery operated L.E.D.'s to indicate whether or not the heater is on. These indicators are small, difficult to see in bright sunlight and are susceptible to damage.

Additionally, currently available boot heating controls use miniature connectors of the type frequently used on calculators. These miniature connectors have no moisture or mechanical protection and are susceptible to corrosion.

Since many boot heaters have controls integrally molded into the boot to achieve stability and ruggedness, damage to the electrical system, which renders the control inoperative, result in a permanently attached component which is useless. Additionally, such integrally formed attachments occupy a significant portion of the boot, thus, limiting the boot designer's choice with respect to components normally used for boot adjustment. Additionally, the permanent nature of the boot control for those ski boots which the control is an integral part, preclude detachment of the heater when it's not needed.

SUMMARY OF THE INVENTION

It is an object of the present invention to overcome many of the deficiencies inherent in boot heater controls, both of the type that are permanently incorporated into ski boots and the like, and boot heater controls which have been developed as attachable components.

Thus, it is an object of the present invention to provide improved control for a boot heater which is virtually shockproof and impervious to the normal abuse to which ski boots are subjected during use.

A further object of the present invention is to provide an improved boot heater control which is selectively detachable from the ski boot when not in use, but which when used, is rugged, compact and not likely to interfere with normal ski boot usage.

A further object of the present invention is to provide an improved boot heater control having a passive mechanism for identifying the on/off state of the control. The control is easy to see in bright sunlight, cannot be damaged and does not require battery power for operation.

A further object of the present invention is to provide an improved boot heater control that makes use of rugged electrical connections that are not likely to be dislocated or damaged in use, and are not likely to be impaired by weather.

A further object to the present invention provides a battery operated boot heater control in which batteries may be readily replaced and in which the battery housing may be removed from the boot when the heater is not in use.

A further object of the present invention is to provide an improved boot heater control which is watertight and weatherproof.

A further object of the present invention is to provide an improved boot heating control which is easy to use and to operate by a skier, even wearing ones ski mittens.

In the present invention, there is provided a boot heater control for use with an electrical heating element normally positioned in a ski boot and connected to electrical leads having terminals extending outwardly of the boot. A mounting bracket secured to the boot has positive and negative electrical contacts on a face of the bracket with leads connected to the other ends of these electrical contacts by means of monitoring screws. A battery housing, shaped to receive the mounting bracket contains at least one battery. The housing and bracket are secured together for relative rotation between at least two positions. The bracket and housing are normally springloaded together in a watertight seal with electrical contacts provided in the housing and bracket for interengaging and disengaging the battery with the heating elements, whereby the heating element is energized when the housing and bracket are in one relative position and deenergized when the bracket and housing are in the other relative position.

BRIEF DESCRIPTION OF THE DRAWINGS

The foregoing objects and advantages of the present invention will be more clearly understood when considered in conjunction with the accompanying drawings, in which.

DETAILED DESCRIPTION OF THE DRAWINGS

Figure 1:
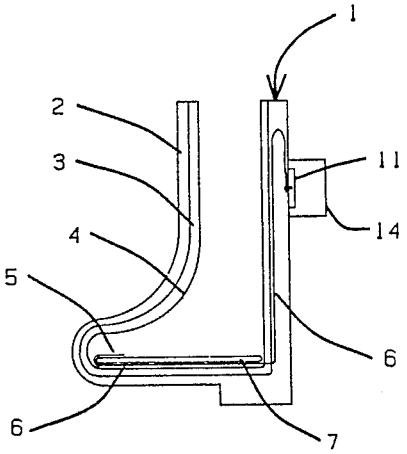
FIG. 1 is a cross sectional, somewhat schematic, illustration of a ski boot embodying the invention.

The boot heat control of the present invention is schematically illustrated in FIG. 1 in an embodiment of a ski boot 1. The boot 1, includes a boot shell 2, which envelopes a liner or in some instances, a bladder 3. The usual closures, buckles and adjustments conventionally used in ski boot construction, while not illustrated, may be incorporated into these designs. In many heating systems used in boots, there is also provided a sock lining 4 having a foot shape. The lining 4, rests on the liner insulation 2. In some boot constructions, the heating system comprises a heating element 5 which may be positioned at the toe of the boot and is suitably secured to the removable sole plate 7 by cement or other suitable means. The heating element 5, is of conventional design and may comprise an appropriate resistive heater adapted to be heated when electrical current is passed through it. The heating element 5, may take a variety of forms. For example, it may comprise a flexible mylar printed circuit board having a serpentine pattern positioned at the toe end of the lining 4. This heating element 5 is extended to form a pair of ribbon conductive leads 6. These leads 6 are secured by cement or other appropriate means to the bottom surface of the sole plate 7 and extend rearwardly of the lining 4 through a slit 8 in the back of the bladder 3 to the inner surface of boot shell 2. The leads 6 are connected to spade lugs which are attached to screws passing through the shell of the boot. These screws provide the dual function of making electrical connection and securing the mounting plate to the boot. Such design may be typically used in front or rear entry boots. In some rear entry boots which have insufficient space on the rear of the boot, the leads 6 may be brought up along the side of the boot near its rear entry, to a terminal preferably on the outside lateral surface of the boot near its upper end. The ends of the ribbon leads 6, are ordinarily connected to spade connectors or other suitable connectors 9. These spade connectors 9 electrically engage a pair of mounting screws 10. The mounting screws 10, secure the square mounting bracket 11 flush against the boot at its rear surface. The facing surface 12 of the bracket may be appropriately curved or slightly recessed to accommodate the curvature of the boot at its rear surface. The mounting bracket 11 is made of an electrically insulating material such as a polycarbonate or ABS plastic. The mounting screws 10 are engaged into stainless steel inserts with flattened heads 13 on the outer surface.

A housing 14, is formed with a depending annular skirt or sidewalls 15, defining a recess 16 on the inner side of the housing. The recess 16 has a width, height and depth conforming to the bracket 11 with the dimensions of the recess selected to permit a relatively close fit between the housing and the bracket when the housing is fitted over it.

The housing 14 is secured to the bracket by means of an deep slotted screw 17 which is positioned in a centrally located opening 18 in the housing with its threaded end 19, threaded into a central opening in the bracket 11. The screw 17, is secured against disengagement from the housing 14 under the pressure of the spring 22 by a retaining ring 20.

The housing 14 is formed with an end wall 21, the outer surface of which, forms the inner wall of recess 16. The wall 21, is also formed with a hole through which the screw 17 projects. A helical spring 22 is coaxial with the screw 17. One end of the helical spring 22 engages the inner surface of the screw head 23. The other end of the spring engages the wall 21 about the inner periphery of the opening through which the screw 17 projects.

Figure 2:
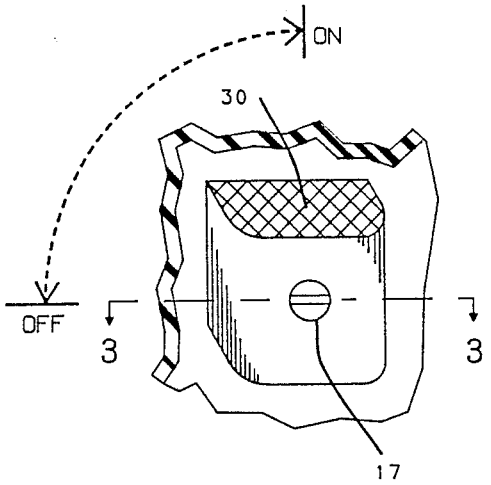
FIG. 2 is a perspective view of the heating control of the present invention.
Figure 3:
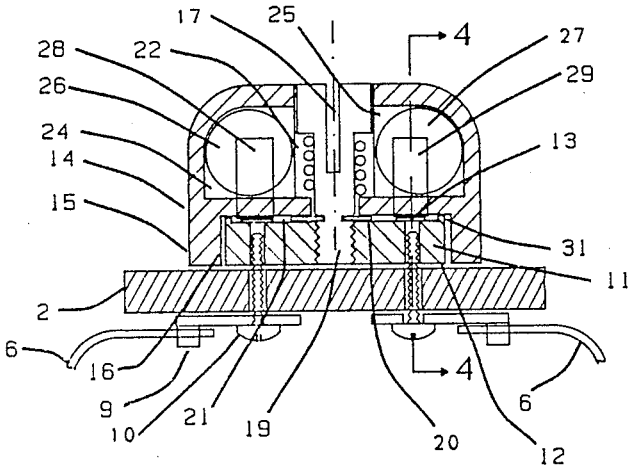
FIG. 3 is a cross-sectional view of the heating control unit taken along the line 3—3 of FIG. 2.
Figure 4:
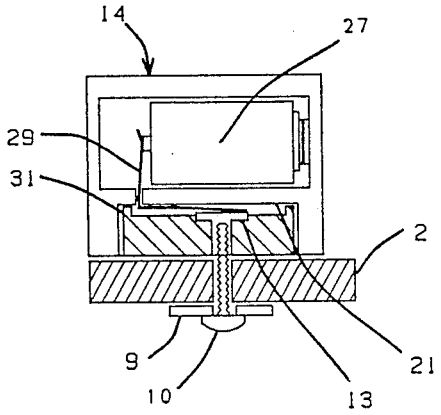
FIG. 4 is a cross sectional view taken along the line 4—4 of FIG. 3.

A pair of chambers 24 and 25, are formed on either side of the screw 17 and are shaped and sized to receive batteries 26 and 27. The batteries 26 and 27, are connected in series by a conductive lead (not shown), with the other ends of the batteries 26 and 27 connected respectively to the metal contacts 28 and 29 which extend through the wall 21 to the inner surface of chamber 16. The metal contacts 28 and 29 are positioned with their ends on the surface of wall 21 to be moved between a position respectively in electrical contact with the heads of the mounting screws 10 in one position, and out of electrical contact with these heads when the housing 14 is orthogonally related to the position shown in FIG. 2. The positioned illustrated in FIG. 3 is a normal 'on' position, in which the batteries 26 and 27 are electrically connected respectively through the contacts 28 and 29 to the heads 13 and to the electric leads 6. In this position, current is supplied from the batteries through the metal contacts 28 and 29, to spade connectors 9, lead 6 and to the heating element 5.

To disengage and turn off the heating element, the housing 14 is moved axially with respect to the screw 17 against the tension of spring 22 until the skirt 15 clears the sidewalls of bracket 11, permitting the housing to be rotated 90°. The housing may then be released with the electric contacts 28 and 29 orthogonally related to and out of contact with the pair of mounting screws 10.

The housing 14 may be provided with a flat surface 30 (FIG. 2) that has a color contrast with the remaining portions of the housing. The surface 30 may, for example, be colored red, while the remaining portions are colored black or white. The surface 30 may be arranged so that when the batteries are normally connected to the heating element, the surface is upright.

The arrangement illustrated should be made with a spring 17 having enough tension to normally hold a sealing lip 31 in weathertight contact with the mating surface 21 of housing 14.

In use, a skier may readily turn the housing between an 'on' and 'off' position by simply pulling the housing 14 away from the boot, against the tension of the spring 22, until the housing clears the bracket, and then rotating it to the other of the two selected positions. On rotation, the housing is released and the spring tension of spring 22 returns the unit to its normal watertight position.

Accidental rotation of the control to either inadvertently turn it on or off is virtually impossible because of the required dual movement for changing the state of the control. As noted, the housing must first be pulled axially from the boot before the heater can be either turned from one condition to another.

The entire battery pack is typically hermetically sealed by ultrasonic welding, and permanently closed. Since most of the cost of the battery pack is in the cost of the rechargeable batteries, if the batteries wear out, the entire battery pack is replaced.

The battery pack is typically removed with a key shaped screwdriver which conveniently fits on a key ring and carried with other keys, thereby eliminating the necessity of keeping track of a special tool.

The housing 14 may be formed with recesses containing a rechargeable battery as illustrated. A battery charging unit having terminals shaped to conform with the bracket of the present invention is used to recharge the batteries. Two battery packs are typically screwed on to opposing sides of the charger in the identical fashion in which they are mounted on to the ski boot.

In an alternative form of the invention, the housing 14, has a removable end cover 30, which permits access to the Cavities 24, and 25 for replacement of the batteries. This permits the use of disposable batteries. To remove and replace batteries 26 and 27, the end cover 30 is removed by removing two small flat head screws (not shown) on its surface. These can be removed with the same key screwdriver which removes the entire battery pack.

What is claimed is:

1. A boot heating system for use in a ski boot and the like comprising;

an electrical heating element positioned in said boot and adapted when electrically energized to generate heat in said boot, conductive leads connected at one end to said elements;

a mounting bracket secured to said boot having positive and negative electrical contacts on a face thereof and with open ends of said leads connected thereto;

a battery housing shaped to receive said mounting bracket and contain at least one battery;

means securing said housing and bracket together in one of a plurality of positions relative to each other;

means permitting relative movement of said housing and bracket from one to the other of said positions; and electrical contact means for selectively electrically interengaging and disengaging said battery and said positive and negative electrical contacts whereby said heating element is energized when said housing and bracket are in, said one position and deenergized when in, said other position.

2. A boot heating system as set forth in claim 1 wherein said means permitting relative movement of said housing and bracket include spring means normally tensioning said housing toward said bracket, and means for limiting relative movement of said housing and bracket to include movement between said first and other position.

3. A boot heating system as set forth in claim 2 wherein said means limiting relative movement includes means permitting rotational movement of said housing and relative brackets.

4. A boot heating system as set forth in claim 3 wherein said means limiting relative movement includes a shaft interengaging and permitting relative rotational movement thereabout is said housing and bracket.

5. A boot heating system as set forth in claim 4 wherein said spring means includes a helical spring coaxial with said shaft and normally spring loading said housing toward said bracket.

6. A boot heating system as set forth in claim 5 wherein said bracket has a polygon shaped sidewall and said housing has depending sidewalls defining a recess in one wall of said housing shaped to confirm closely to side bracket sidewalls.

7. A boot heating system as set forth in claim 6 wherein said shaft comprises a screw having a threaded end extending into said face of and engaging said bracket, said housing formed with an opening through which said screw extends with means forming an inwardly extending flange in said opening adjacent said bracket, said spring having one end engaging said inwardly extending flange and the other end engaging the head of said screw.

8. A boot heating system as set forth in claim 1 wherein said housing has means on the outer surface therefore providing a visual identification of a said relative position of said housing to said bracket.

9. A boot heating system as set forth in claim 8 wherein said bracket has a polygon shape and said housing has means forming a recess corresponding to said polygon shape to receive said bracket in said one is said other positions, and said housing has an outer surface having indicies thereon for indicating the relevant position of said housing to said bracket.

10. In a boot heating system a control for selectively connecting battery generated power to a heating element in the boot through conductive leads having terminals extending through said boot comprising;

a bracket having electrical contacts adopted to be connected to said terminals at one end;

a housing shaped to fit in watertight engagement with said bracket in one of two selected positions, said housing shaped to carry at least one battery and electrical contacts for selective electrical interengagement with said bracket contacts and spring means for normally maintaining said housing and bracket in said watertight relation.

11. In a boot heating system having a switch means for selectively connecting battery generated power to a heating element in the boot through conductive leads having terminals extending through said boot, comprising:

a bracket having electrical contacts, adapted to be connected to said terminals at one end;

a housing shaped to fit in engagement with said bracket, said housing being shaped to carry at least one battery and electrical contacts;

means for mounting said housing on said bracket for rotational movement with respect thereto;

spring means for normally maintaining the housing and bracket in mechanical contact with one another;

said bracket, housing and spring means being so constructed and arranged with said housing can be moved between a switch engagement position in which the housing and bracket electrical contacts are in engagement with one another and a switch disengagement position in which said respective contacts are out of engagement with one another by pulling the housing outwardly against the spring force, rotating the housing from one of said positions to the other and then releasing the housing so it again seats on the bracket.

* * * * *